US007770943B2

(12) United States Patent
Kaiser

(10) Patent No.: US 7,770,943 B2
(45) **Date of Patent: *Aug. 10, 2010**

(54) WINDOW OR DOOR HAVING AN ELECTROMECHANICAL LOCKING MECHANISM

(75) Inventor: Konrad Kaiser, Geseke (DE)

(73) Assignee: Schueco International KG, Bielefeld (DE)

( * ) Notice: Subject to any disclaimer, the term of this patent is extended or adjusted under 35 U.S.C. 154(b) by 196 days.

This patent is subject to a terminal disclaimer.

(21) Appl. No.: 11/544,749

(22) Filed: Oct. 10, 2006

(65) Prior Publication Data

US 2007/0089370 A1 Apr. 26, 2007

Related U.S. Application Data

(63) Continuation of application No. PCT/EP2005/003659, filed on Apr. 7, 2005.

(30) Foreign Application Priority Data

Apr. 8, 2004 (DE) ..... 10 2004 018 062

(51) Int. Cl.
*E05C 1/06* (2006.01)

(52) U.S. Cl. ..... 292/144; 49/280

(58) Field of Classification Search ..... 49/192, 49/280, 193, 382; 292/144, 201; 200/61.85; 244/129.4

See application file for complete search history.

(56) References Cited

U.S. PATENT DOCUMENTS

| | | | | |
|---|---|---|---|---|
| 3,745,842 A | | 7/1973 | Brems | |
| 4,680,891 A | * | 7/1987 | Perkins | 49/280 |
| 5,226,256 A | * | 7/1993 | Fries et al. | 49/13 |
| 5,369,911 A | * | 12/1994 | Fortunato | 49/25 |
| 5,715,712 A | * | 2/1998 | West | 70/257 |
| 5,987,818 A | * | 11/1999 | Dabideen | 49/280 |
| 6,139,070 A | * | 10/2000 | Piltingsrud | 292/144 |
| 6,282,838 B1 | * | 9/2001 | Yoshikawa | 49/193 |
| 6,883,840 B2 | * | 4/2005 | Sueyoshi et al. | 292/336.3 |
| 7,073,827 B2 | * | 7/2006 | Cherry | 292/201 |
| 2004/0128914 A1 | * | 7/2004 | Hempelmann | 49/192 |
| 2007/0068082 A1 | | 3/2007 | Kaiser | |

FOREIGN PATENT DOCUMENTS

| | | | |
|---|---|---|---|
| DE | 195 14 051 A1 | | 10/1995 |
| DE | 101 05 845 A1 | | 8/2002 |
| DE | EP 132 3 885 | * | 7/2003 |

OTHER PUBLICATIONS

International Search Report dated Oct. 28, 2005.

* cited by examiner

*Primary Examiner*—Gary Estremsky
(74) *Attorney, Agent, or Firm*—Crowell & Moring LLP

(57) ABSTRACT

A window or door including a circumferential blind frame and a leaf with a surface element is provided, which can be pivoted about one or more axes in relation to the blind frame, as well as including fittings, located between the leaf and the blind frame, which are used for moving the leaf in relation to the blind frame. Electromechanically actuated locking elements are provided for locking the leaf into the blind frame. Each locking element has its own electromechanical drive, and/or the locking elements are configured such that, when the window is closed, they are displaced in relation to the pane plane, thus pressing the leaf perpendicularly against the blind frame with a predetermined contact force.

17 Claims, 5 Drawing Sheets

WINDOW OR DOOR HAVING AN ELECTROMECHANICAL LOCKING MECHANISM

CROSS-REFERENCE TO RELATED APPLICATIONS

This application is a continuation of PCT International Application No. PCT/EP2005/003659, filed on Apr. 7, 2005, which claims priority under 35 U.S.C. §119 to German Application No. 10 2004 018 062.8, filed Apr. 8, 2004, the entire disclosures of which are expressly incorporated by reference herein.

BACKGROUND AND SUMMARY OF THE INVENTION

The invention relates to a window or a door having a preferably circumferential blind frame and a leaf with a surface element, which may be pivoted about one or more axes in relation to the blind frame. Fittings, located between the leaf and the blind frame, are provided for moving the leaf in relation to the blind frame. Electromechanically actuated locking elements are provided for locking the leaf into the frame, after a manual or separate electromechanical closing of the leaf.

German patent document DE 195 14 051 discloses doors as well as side-hung windows or bottom-hung windows, the locking mechanisms of which are actuated electromagnetically for locking the leaf into the blind frame. The movement of a swivel lock into its lock position, in which the lock engages in a recess in the door leaf, takes place under the influence of a spring force on the swivel lock, whereas the swivel lock is opened or rather disengaged electromagnetically while simultaneously tensioning the spring.

In addition, there also exist doors, where several locking elements are actuated jointly by an electric motor, so that a gear, connecting the locking elements, is necessary.

Doors have lower requirements with respect to tightness than windows, since there is no circumferential sealing plane in the area of the floor. Thus, for doors it is sufficient if the sealing edge of the leaf rests against the seals of the blind frame.

In contrast, the sealing requirements imposed on windows is higher owing to the installation at exposed altitudes (high rise buildings, mountain peaks, etc.). That is, a certain clamping force ought to be exerted on the perimeter seals between the blind frame and the casement frame.

When the window casement is closed, this clamping force has to be overcome, a feature that is not possible with the means described in the prior art, especially in DE 195 14 051. The sealing contact pressure is necessary for the requirement of classifying windows in accordance with the standard for tightness and pelting rain resistance.

The invention is based on the problem of providing a window or a door with an improved electromechanical locking function.

The invention solves this problem by providing a window or door having a preferably circumferential blind frame and a leaf with a surface element, which may be pivoted about one or more axes in relation to the blind frame. Fittings, located between the leaf and the blind frame, are provided for moving the leaf in relation to the blind frame. Electromechanically actuated locking elements are provided for locking the leaf into the frame, after a manual or separate electromechanical dosing of the leaf. Each locking element has its own electromechanical drive, and/or the locking elements are configured such that, when the window is closed, they are displaced in relation to one another perpendicularly to the pane plane, whereby the leaf is pressed against the blind frame with a predetermined contact force.

Advantageous embodiments are described and claimed herein.

According to an embodiment of the invention, each locking element exhibits its own electromechanical drive mechanism and/or the locking elements are configured in such a way that, when the window is closed, they are displaced in relation to the pane plane, thus pressing the leaf perpendicularly against the blind frame with a predetermined contact force.

Such an electromechanical drive at each locking element constitutes an inexpensive solution, which makes it possible to dispense with gear connections between the individual locking mechanisms.

This feature includes, advantageously, an alternative, which may also be viewed independently and which ensures in a simple way that, when locking, a leaf is displaced perpendicularly to the pane plane and the leaf plane and is pressed against the blind frame with a predetermined contact force. According to this alternative, however, when the window is opened or closed, the window or the door does not exhibit its own drive in order to move the leaf, but rather only a locking mechanism, which engages when the leaf has already been closed manually (or, under some circumstances, also closed separately electromechanically), and a corresponding locking command is sent to an operating element.

Preferably, the locking elements are configured in such a manner that the time for locking upon closing the leaf is longer than the time for unlocking prior to opening the leaf, a feature that has a very beneficial effect on operating the window.

In itself, arbitrary operating elements can be employed. However, according to another alternative, an especially preferred operating element is a handle, which is mounted on the leaf and has a grip piece, which can be moved—in particular, can be turned—into a number of gripping positions on the leaf, the gripping positions corresponding to the various operating positions of the leaf. The handle exhibits switching elements and/or sensors; and the handle is connected in a wireless manner or by electric lines to the electromechanical locking elements between the leaf and the blind frame and/or with electromagnetic or electromechanical functional elements, in particular coupling elements, for at least one or more of the fittings.

It is especially preferred that the handle including the locking elements and/or the fittings is not connected by way of mechanical elements, like a gear, but is designed for manual opening and closing of the leaf.

Each locking element has, preferably, an electromechanically driven locking slide—preferably on the blind frame and/or on the leaf—, which is designed for engaging behind a corresponding locking abutment on the leaf and/or on the blind frame. The abutment may be constructed as a closing roller or as a stationary bolt.

To reach a predetermined closing force, at least one of the locking slides is provided preferably with a control curve, in particular a tightening slope, which is configured for the purpose of moving, on extending out the locking slide, the stationary locking abutment and, thus, the leaf in the direction of the blind frame, and for the purpose of locking the locking abutment into the blind frame with a predetermined force.

According to another alternative, the locking slide exhibits a projection with a predetermined reach; and the moveable locking slide can be extended so far that the stationary locking abutment reaches a position, in which it slides past the projection so that the leaf in this position may disengage extremely fast from the blind frame.

According to another advantage alternative, which is supposed to enable an extremely fast unlocking, the electromechanical drive mechanism exhibits an unlocking spring.

The electromechanical drive mechanism is designed preferably for the purpose of moving the locking slide and putting the unlocking spring under tension.

The tensioning of the unlocking spring may be carried out in a simple way by use of an eccentric arrangement together with the movement of the locking slide.

According to a structural alternative, which shall be realized in a simple way, the eccentric arrangement exhibits an eccentric pin, moving on a circular path.

The drive mechanism includes preferably a drive housing, which accommodates an electric motor and a gear and preferably the unlocking spring, in particular a helical spring.

The unlocking spring envelops preferably the locking slide and is braced against two stops.

According to an advantageous alternative, the eccentric pin acts on a radial stop on or around the locking slide, so that, as the eccentric pin moves initially on its circular path for locking, it advances the locking slide outwards out of the drive housing until, as the pin continues to traverse the circular path in the unlocking process, it reaches a position, in which the tension on the unlocking spring may be relaxed.

At the same time an advantageous design is offered in such a way that after traversing less than half the circular path of the eccentric pin about the center point, the locking position is reached and that as the eccentric pin continues to traverse the circular path, the moveable locking slide extends further until it reaches a position, in which the leaf in turn may disengage very quickly from the blind frame.

The invention makes realizable a leaf locking, which is linked electrically together in a point-by-point manner, and preferably also such an actuation of the fittings that at least the fixing of the fittings for a turn, tilt and/or lock position and of the locking mechanisms for a lock position, is carried out in a force actuated manner, i.e., by way of a motor. The unlocking or rather disengagement of the fittings may also be carried out by way of a motor or spring assistance.

Kinematic reversals, e.g., with control curves at the locking abutments, can also be realized. Similarly, the electromechanical drive may be put in the leaf and the abutment on the blind frame.

The invention is described in detail below by means of the embodiments with reference to the drawings.

Other objects, advantages and novel features of the present invention will become apparent from the following detailed description of the invention when considered in conjunction with the accompanying drawings.

DETAILED DESCRIPTION OF THE DRAWINGS

Figure 1:
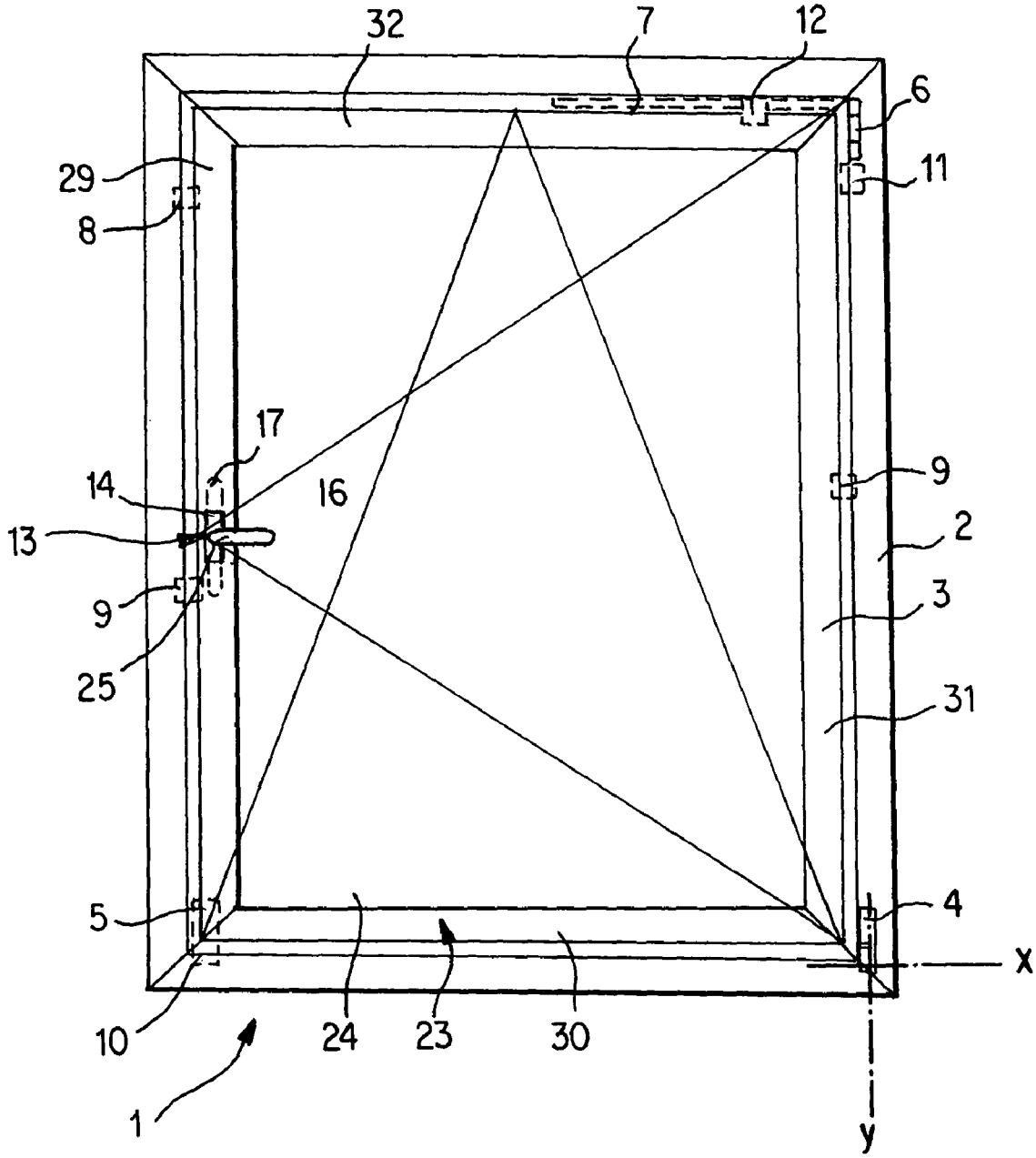
FIG. 1 is a schematic view of a turn-tilt window with a first handle.

FIG. 1 depicts a turn-tilt window 1 including a blind frame 2 and a leaf 23, which exhibits here a casement frame 3 and holds a pane 24.

The turn-tilt window is arranged so as to be tiltable about a first axis x, oriented horizontally in the standard installation position, and is arranged so as to be rotatable about a second axis y, which is vertical here.

For this purpose the window 1 exhibits a turn and tilt bearing 4, a disconnectable rocker bearing 5, and a pivot bearing 6, as the fittings, which are intended for moving the leaf and are located between the blind frame 2 and the casement frame 3. The pivot bearing is constructed as a turn hinge and is fastened on the casement frame 3 and is fixed in a disconnectable manner in the blind frame 2. In addition, there is also a deployment device 7.

Depending on whether the window is tilted or turned, or whether it is closed, these fittings, or rather in this case these bearings, are or are not in their functional position. Therefore, during tilting movements, the rocker bearing 5 is in its functional position; and the pivot bearing 6 is not. In contrast, during turning movements the pivot bearing 6 is in its functional position; and the rocker bearing 5 is not.

The turn hinge 6 is coupled in a disconnectable manner, as a function of its design, to the blind frame 2 or to the casement frame 3 in the lock position of the window and in the swivel position about the Y axis and is rigidly disposed correspondingly on the casement frame or blind frame. In the latter case the pivot bearing 6 and the deployment device 7 form a unit.

Furthermore, in the turn-tilt window, depicted in FIG. 1, a subgroup of the fittings, which are necessary for realizing the moveability between the leaf and the blind frame—in this case the rocker bearing 5 and the pivot bearing 6 as well as also the deployment device 7—has functionally at least one electromechanical functional element 10, 11 or 12, with which the fittings 5, 6 and 7 are coupled into or uncoupled out of their functional position, as function of the actuation in their functional position, in order to move the leaf 23 either into its tilt position or into its turn position or to lock the leaf 23 into its lock position in the blind frame 2.

The "activation" and/or "deactivation" of the rocker bearing 5 and/or the pivot bearing 6 is/are carried out by way of electromechanically acting coupling elements 10, 11. The electromechanical element 10 controls and/or couples the rocker bearing 5 between the leaf lock position and the leaf turn position about the X axis, on the one hand, and the disengagement position for the swivel position of the leaf about the Y axis.

The electromechanical element 11 ensures, on the one hand, the fixing of the pivot bearing 6, which is disposed on the leaf 23, in the blind frame 2 in the leaf position and the swivel movement about the Y axis and, on the other hand, releases the pivot bearing 6, when the leaf 23 is positioned in the X axis.

Furthermore, the edge of the window has a deployment device 7, as another moveable fitting, located between the blind frame 2 and the casement frame 3. The deployment device is used for defining the tilt position of the leaf in relation to the blind frame 2. The deployment device 7 may also be connected to the turn hinge 6. Then, the turn hinge 6 is attached to the blind frame 2 and can be coupled to the leaf 23 by use of the deployment device. Furthermore, the deployment device 7 may be used optionally for opening and dosing the turn-tilt window in and out of the tilt position by way of elements (not illustrated here), like an electric motor and a gear—in particular a chain or cable, to be attached to the deployment device.

The functional element 11 ensures the disengagement of the pivot bearing 6 at the leaf 23 during the pivot movements about the Y axis in its functional position. During the tilt movements, in contrast, the pivot bearing is disabled in its deactivated position. The other functional elements 10, 12 work in a manner analogous to the rocker bearing 5 and the deployment device 7, the movements of which are either deactivated and/or blocked or released, for example, by way of electromechanically operated coupling elements including moveable bolts or the like.

Locking elements 8, 9, located between the blind frame 2 and the casement frame 3, are arranged in or on the rebated area, existing between the blind frame and the casement frame, point-by-point or rather only at individual spots of the rebated area that are set apart from each other. The locking elements bridge the rebated area and are used to lock the leaf 23 into the blind frame 2 in the lock position of the window. There are here, by way of example, three locking elements on the edge of the leaf on the side of the turn hinge 6 and the edge of the casement frame 3, which is located opposite the turn hinge 6.

It is also contemplated to provide additional locking elements 8, 9 on the other sides, especially on the top side and the bottom side of the window, and/or a different number of locking elements 8, 9. In this case, the locking elements 8, 9 can be actuated in a wireless manner or by way of electric lines (cannot be recognized here) and exhibit an electromechanically acting locking element. An electromechanical locking element, like a locking slide, is preferred in order to generate an adequate amount of locking force, optionally in connection with additional translation elements, like tightening slopes, eccentrics, expanding wedges or the like. Therefore, the locking procedure shall be carried out preferably by way of the electromechanical drive and the unlocking procedure, according to an alternative, by way of an unlocking spring, since in general when a window is opened, there is less time available than when closing and subsequently locking the window.

A handle 13, which is mounted on the casement frame 3 and has a grip piece 25, which can be moved—in this case turned—into different gripping positions on a shaft in relation to the blind frame 3, is used as the actuating element for the leaf 23.

The gripping positions of the handle 13 are to be distinguishable by a user on visual inspection. In the gripping positions, which differ from each other by a number of angles, in this case 90 deg., and are provided here by way of example for a turn-tilt window, the leaf 23 is either locked, or can be tilted or turned.

The handle 13 is used here for the purpose of both tilting and turning the window, thus for generating the mechanical force to move the leaf 23 in relation to the blind frame. However, the handle 13 is not used, as otherwise typical, for the purpose of actuating the locking elements and/or the fittings by way of a mechanism. Rather, this task is carried out here by way of electrical lines or in a wireless manner without any mechanical connection to the fittings 4, 5, 6, 7, in that the switching position of the handle 13 is registered by way of a detection device, like switching contacts or sensors (e.g., Reed contacts) and is used for actuating the electromagnetically or electromechanically acting locking and functional elements, in order to use the fittings in either the tilting functional position or the turning functional position or to close the window.

In FIG. 1, the handle 13 is configured in such a way that the downwards pointing gripping position is equivalent to the lock position of the window, in which all of the locking and functional elements 8, 9; 10-12 are located in the locking and/or lock position.

In contrast, the gripping position 16 corresponds to the option of displacing the leaf 23 into its turn position. In this gripping position, the locking elements 8, 9 and the functional element 10 for the rocker bearing 5 are unlocked.

However, in the tilt position—in this case where the gripping position of the handle is pointing upwards—the leaf 23 may be tilted so that in this gripping position the locking elements 8, 9 and the functional element 11 for the pivot bearing 6 are unlocked.

The handle 13 is not connected to the locking elements 8, 9 or the fittings by way of any mechanical elements, like a gear, especially a connecting rod assembly. Since a mechanical gear connection between the handle and the locking elements and the fittings is dispensed with, the cost of manufacturing the window is reduced, on the one hand; and, on the other hand, it offers the option of transmitting the registered gripping positions to a higher ordered monitoring unit (not illustrated here) by way of a wireless connection or some other connection of the grip piece or the switching and/or sensor elements, which are assigned to the grip piece. This makes it possible, for example, to register and to monitor by means of a central station the position of the window of a building without any additional sensor technology between the blind frame and the casement frame.

According to an advantageous alternative of the invention, the switching and/or sensor elements of the handle 13 as well as optionally other electric or electronic components, like interface components to a databus and/or energy bus of a building's automation system, may be housed in a grip housing 14—in this case, formed as a rosette in the outward direction without negatively modifying the visual impression, compared to conventional, purely mechanically acting handles.

As an alternative, it is also contemplated (not illustrated here) to house an electric circuit for the handle 13 in, or in the vicinity of, the handle 13, thus in the rebated area, a chamber or in a recess of the casement frame.

The handle 13 enables, on the one hand, the customary manipulation of the window and, on the other hand, is used—depending on the configuration—as a switching and/or information module owing to its electronics including sensor and/or switching elements.

Figure 2:
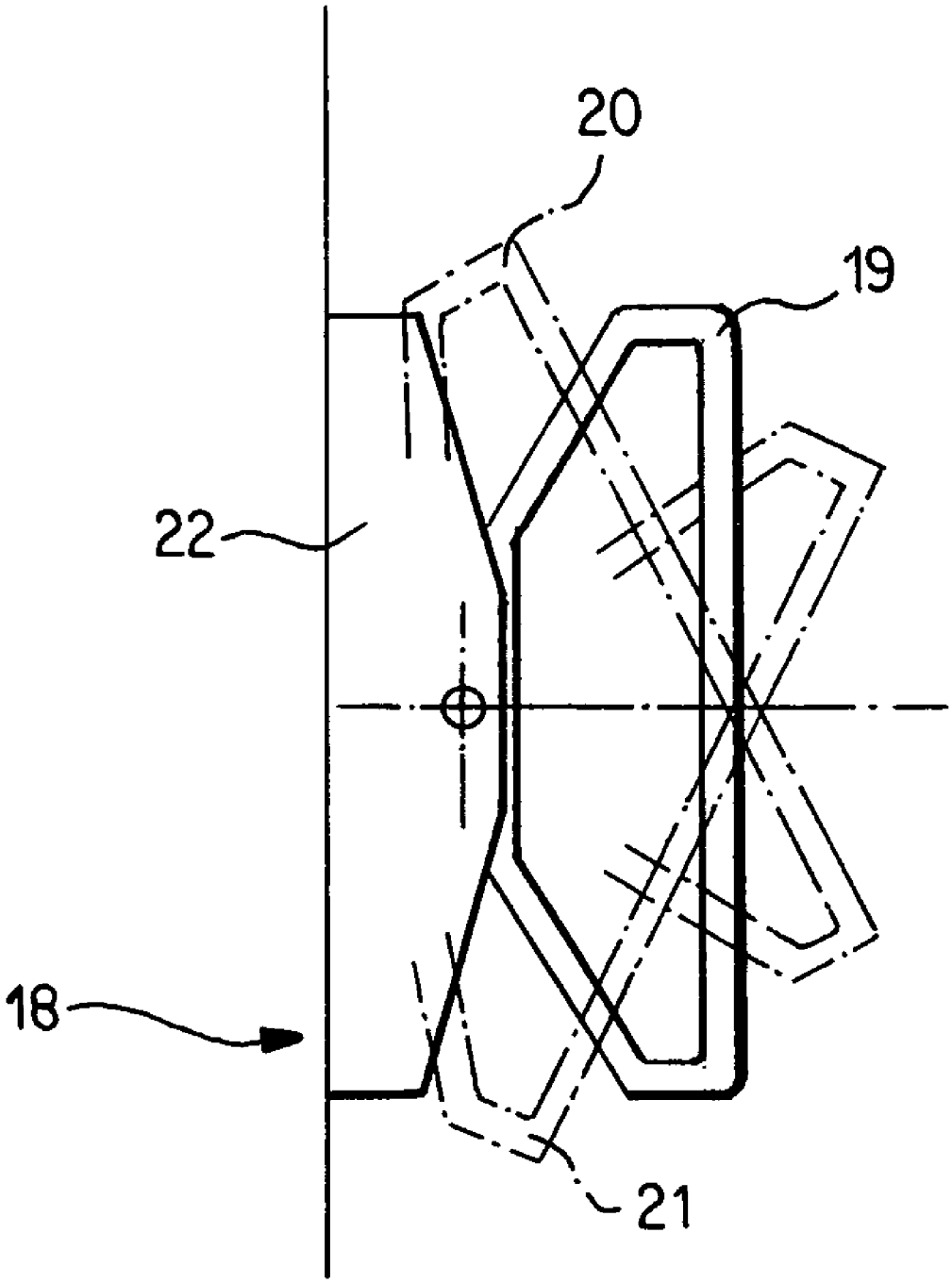
FIG. 2 is a schematic view of another handle for a turn-tilt window in a number of gripping positions.

FIG. 2 depicts another example of a handle 18 for a turn-tilt window. The handle, depicted in FIG. 2, exhibits a loop-type grip 19, which can be turned and/or tilted, like a rocker, into different gripping positions in relation to a grip housing 22, fastened to the leaf 23. In the gripping position, bearing the reference numeral 19, the window is closed; in the position bearing the number 20, it may be displaced into its tilt position; and in the position of the handle 18, bearing the number 21, the window may be displaced into its turn position.

In the case of an embodiment as a bottom-hung or side-hung window, only two gripping positions are necessary.

The number of locking elements 8, 9 varies as a function of the size of the leaf.

In a turn-tilt window of a smaller model, at least one of the locking elements 8 is necessary. Preferably, one of the locking elements 8, 9 is provided on the grip-sided vertical frame strut 29. In the case of larger window casements and as a function of the window installation conditions, the four frame struts 29-32 of the casement frame 3 may have additional locking elements, which lock the leaf virtually point-by-point or rather spot-by-spot.

The connection of the individual locking elements 8, 9 as well as the electromechanical elements 7, 8 and 9 for actuating the fittings 4 and 5 is carried out exclusively by means of electric connections, based on a switching control element for selecting the respective function of the window in the lock, turn or tilt position in the case of turnable or tiltable windows and/or the lock and swivel position in the case of side-hung, bottom-hung or top-hung windows.

Figure 3:
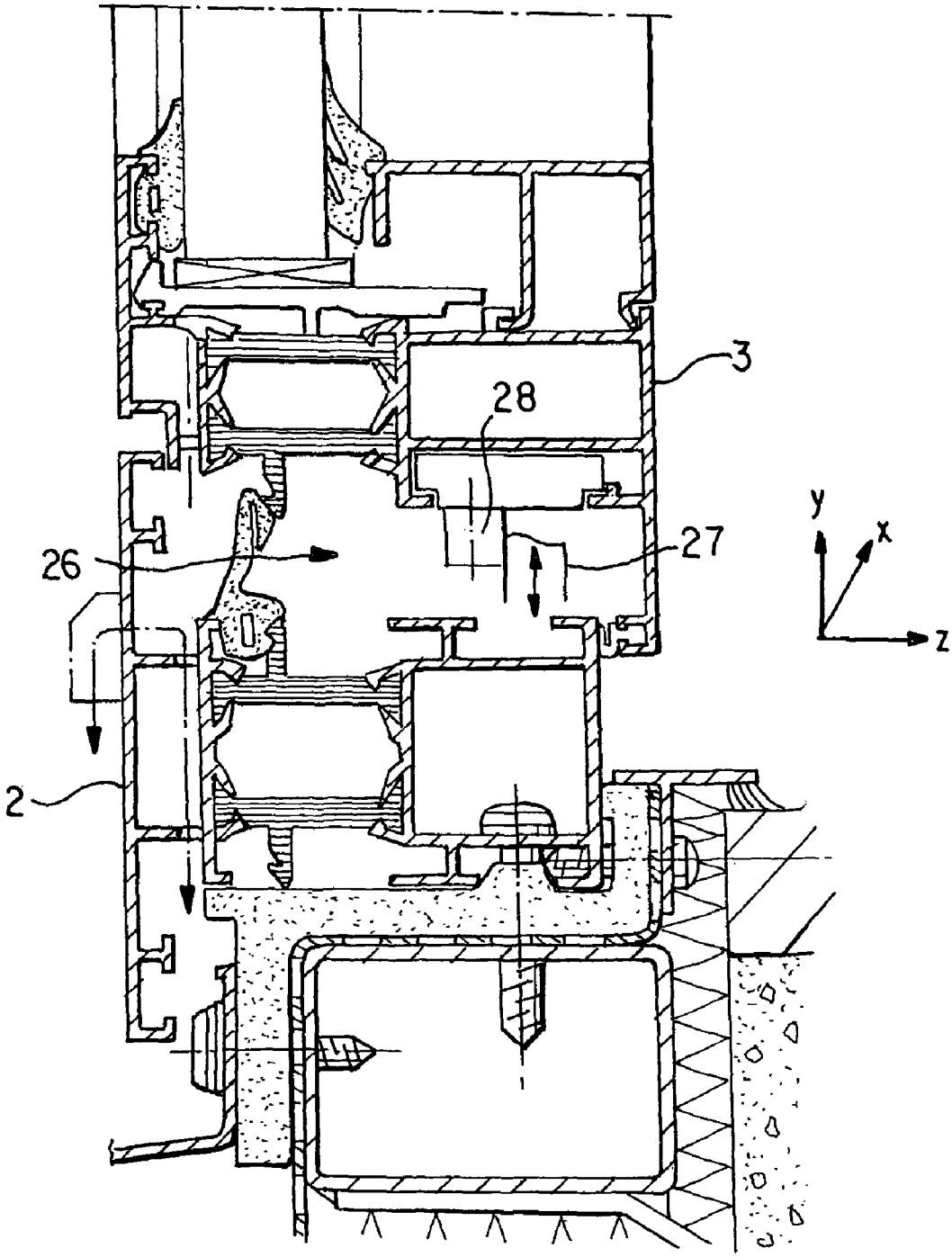
FIG. 3 is a sectional view of a schematic representation of a rebated area of a window.

FIG. 3 is a sectional view of a frame of a window comprising a blind frame 2 and casement frame 3. One of the locking elements 8, 9, which can be operated electromechanically, is represented schematically in the rebated area 26. Each locking element 8, 9 comprises an electromechanically driven, moveable locking slide 27, which can be moved in the direction of the pane plane in the direction of the casement frame 23 and in its locking position engages behind a locking abutment 28, like a roller or a bolt, which is stationary at the leaf or rather cannot be moved in relation to the leaf 23.

Figure 4:
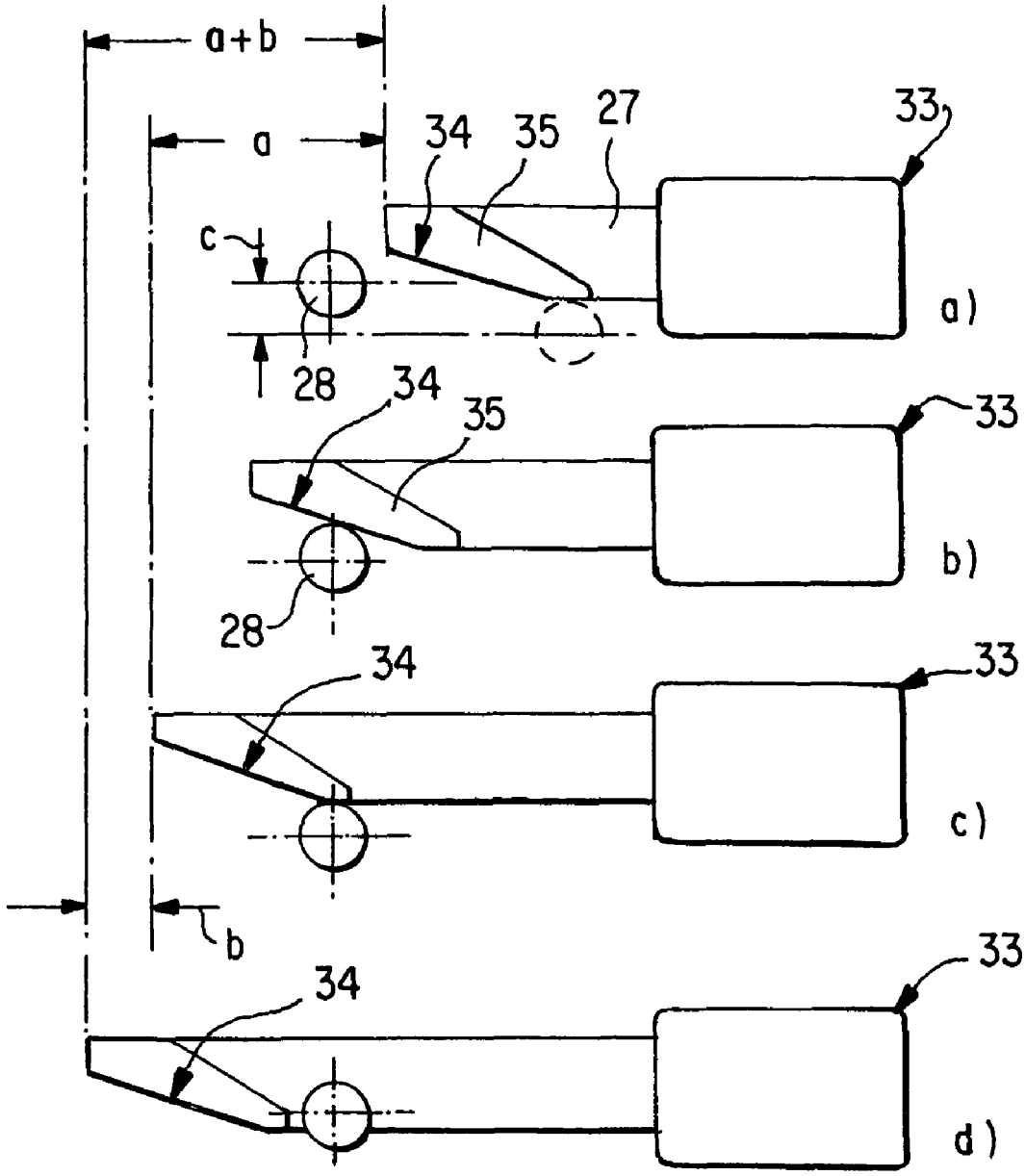
FIGS. 4*a-d* are schematic views of an electromechanically operated locking mechanism for a window in various operating positions.

FIG. 4 is a schematic drawing of such a locking mechanism in various operating positions.

FIG. 4 depicts an electromechanical drive mechanism 33, which is shown merely in a schematic form and which has an electric motor and, preferably, a gear (not illustrated here in detail), connected on the outgoing circuit of the electric motor. This drive mechanism 33 is disposed preferably on the blind frame (or, as an alternative, on the leaf).

According to FIG. 4, the locking slides 27 are provided with control curves, especially tightening slopes 34, in such a way that, on locking with a predetermined force, the leaf 23 is pulled over a path "c" in the direction of the blind frame 2, so that the leaf 23 rests flush against the blind frame 2 with a predetermined force.

The gear enables the linear movement of the locking slide 27 into its axial direction or rather in the direction of the corresponding window section—here the leaf 3—as well as in the direction of the locking abutment 28, which is fixed in position on the moveable leaf (not illustrated here).

The side of the locking slide 27 that faces the locking abutment 28 exhibits a control curve (here a tightening slope 34), which may also be configured on a projection 35, which is molded radially to the actual locking bolt and extends only over a portion, in particular an end area of the locking slide 27.

The function of this arrangement is as follows.

When the window is closed, the locking slide 27 is extended out from a retracted position (FIG. 4*a*) from the blind frame 2 in the direction of the casement frame 3, until the locking slide 27 rests with its tightening slope 34 against the outside radius of the locking abutment 28 (FIG. 4*b*). If the locking slide 27 is extended further, the locking abutment 28 on the leaf 3 as well as the leaf 3 itself are pulled perpendicularly to the pane plane in the direction of the blind frame 2, until a locking position is reached, in which the path of the tightening slope 34 is totally traversed, so that the lock position may also be retained (locking position of FIG. 4*c*), when there is no current flow to the motor.

According to an alternative, the lock path along the tightening slope 34 may be traversed in reverse for the purpose of unlocking (not illustrated).

However, to open the leaf as fast as possible, it is also contemplated to extend the locking slide 27 further until the slide reaches a position, at which it slides past the projection 35 with the tightening slope 34, so that the leaf 23 may disengage extremely fast from the blind frame 2 (FIG. 4*d*).

When the window is locked, the path "a", which is to be traversed linearly by the locking slide 27 in its direction of displacement, is clearly longer than the path "b", to be traversed when unlocking prior to opening (ratio of a to b is significantly greater than 2 to 1), so that even the time that is required until the window is unlocked and may be opened after actuating the operating element, especially after turning the handle 13, is less than the time that is required by the drive to lock the window after, for example, manually closing and then turning the handle 13. This feature is advantageous, because especially the opening procedure is always supposed to be fast, whereas the user is not troubled if it takes longer to lock after closing the window or rather after pressing the leaf against the blind frame 2.

Figure 5:
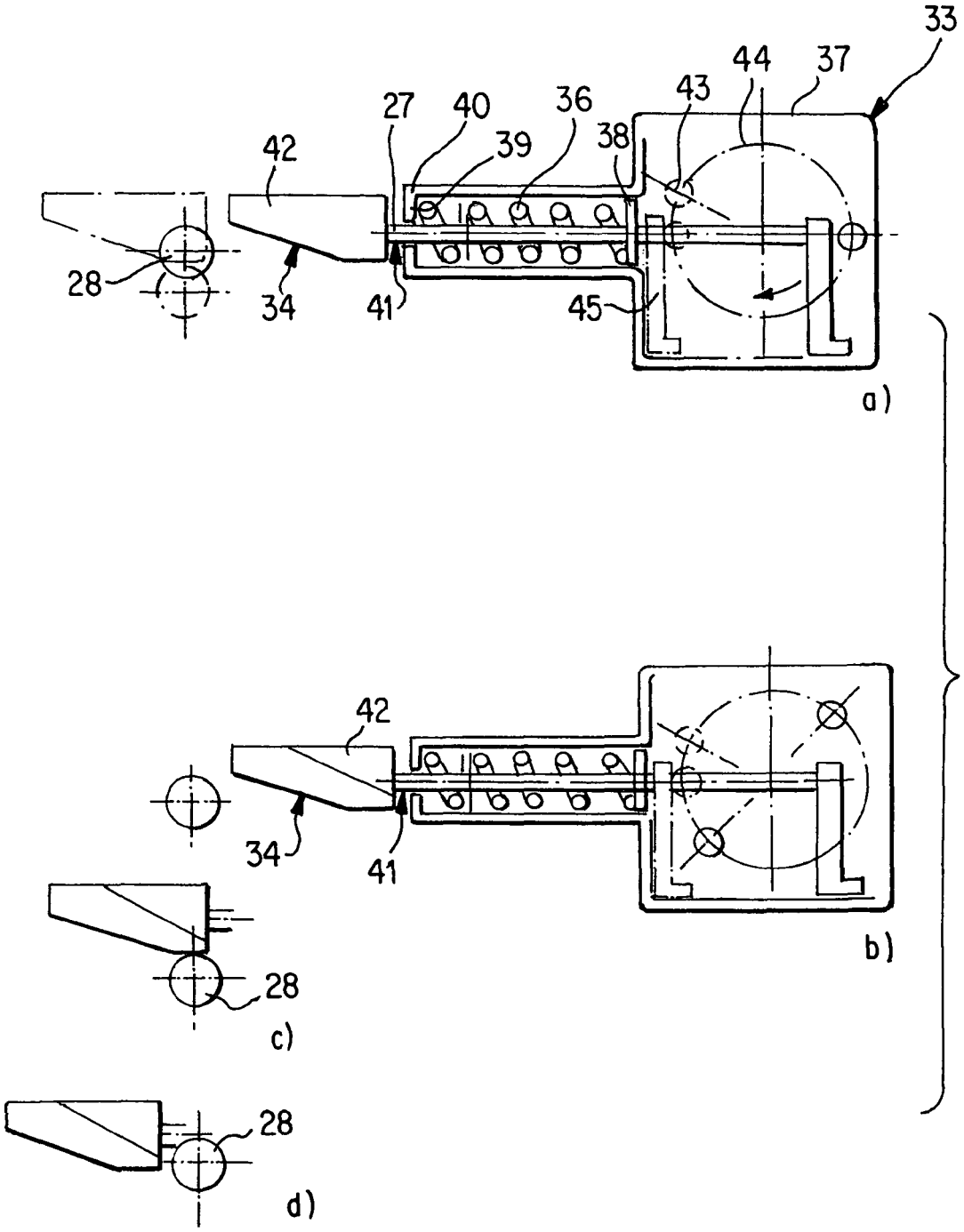
FIGS. 5*a-d* are schematic views of another electromechanically operated locking mechanism for a window in various operating positions.

FIG. 5 shows an alternative embodiment. In this case, the locking procedure is carried out in a manner analogous to that in FIG. 4, but the unlocking is done by use of an unlocking spring 36.

Therefore, a drive housing 37 for the electric motor and a gear is configured in such a way that it also accommodates the unlocking spring 36, in particular a helical spring.

The unlocking spring 36 envelops the locking slide 27 and is braced against two stops 38, 39, which envelop concentrically the locking slide 27. Therefore, one of the stops 38 envelops disk-like the locking slide 27 and is fixed axially to the same; and the other is constructed as a housing wall 40 of the drive housing 34, through which the locking slide 27 extends moveably. The projection 41, protruding beyond the drive housing 37, has a head piece 42 of predetermined length, which in turn is provided with the tightening slope 34.

The locking procedure is carried out as in FIG. 4, but an eccentric mechanism comprising an eccentric pin 43 is configured in the drive housing 37 on the end of the locking slide 27. The eccentric pin moves over a circular path 44; and on closing, it acts on a radial stop 45 on or around the locking slide 27, which is connected stationarily to the locking slide 27, so that the eccentric pin advances via the stop 45 the locking slide 27 outwards out of the drive housing (as far as up to the locking position of FIG. 5*c*).

If the eccentric pin is moved further, it slides past the edge of the stop 45, so that the locking abutment 28 in turn is disengaged, so that the unlocking spring 46 may relax.

In contrast, the circular path 44 of the eccentric pin 43 is measured and adjusted, according to FIG. 5*b*, in such a manner that the closing position is reached as early as after less than half the circular path 44 and that, when the eccentric pin continues to traverse the circular path 44, the locking slide 27 is extended further until it in turn reaches a position, at which the head piece 42 is disengaged so that the leaf 23 in turn may quickly disengage from the blind frame 2 (FIG. 5*d*).

Table of Reference Numerals

| | |
|---|---|
| turn-tilt window | 1 |
| blind frame | 2 |
| casement frame | 3 |
| turn and tilt bearing | 4 |
| rocker bearing | 5 |
| turn hinge | 6 |
| deployment device | 7 |
| locking elements | 8, 9 |
| coupling element | 10, 11, 12 |
| handle | 13 |
| grip housing | 14 |
| lock position | 15 |
| turn position | 16 |
| tilt position | 17 |

-continued

| Table of Reference Numerals | |
|---|---|
| handle | 18 |
| leaf | 23 |
| pane | 24 |
| grip piece | 25 |
| rebated area | 26 |
| locking slide | 27 |
| locking abutment | 28 |
| frame strut | 29-32 |
| drive mechanism | 33 |
| tightening slope | 34 |
| projection | 35 |
| path | a, b |
| unlocking spring | 36 |
| drive housing | 37 |
| stops | 38, 39 |
| housing wall | 40 |
| projection | 41 |
| head piece | 42 |
| eccentric pin | 43 |
| circular path | 44 |
| stop | 45 |
| axes | x, y |
| paths | a, b, c |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus, comprising:

a blind frame and a leaf, the leaf having a surface element and being pivotable about one or more axis in relation to the blind frame, fittings operatively arranged between the leaf and the blind frame for moving the leaf in relation to the blind frame;

electromechanically actuated locking elements for locking the leaf into the frame after a closing of the leaf, each of said locking elements having a separate electromechanical drive; and a handle, which is disposed on the leaf and includes a grip piece movable into a number of gripping positions on the leaf, said gripping positions corresponding to various operating positions of the leaf, said handle further including at least one of switching elements and sensors;

wherein the handle is connected wirelessly or by wire to the electromechanically actuated locking elements between the leaf and the blind frame and/or with electromagnetic or electromechanical functional elements for at least one or more of the fittings, wherein said locking elements are operatively configured such that, when the leaf is closed, the locking elements are displaced in relation to one another in order to press the leaf perpendicularly with respect to a plane of the surface element against the blind frame with a predetermined contact force, wherein the electromagnetic or electromechanical functional elements are provided for at least one or more of the fittings, for moving the leaf in relation to the blind frame.

2. The apparatus according to claim 1, wherein the blind frame and the leaf are components of a window or door.

3. The apparatus according to claim 1, wherein the blind frame is a circumferential blind frame.

4. The apparatus, as claimed in claim 1, wherein the handle is designed for manual opening and closing of the leaf and is not operatively connected to the locking elements and fittings by mechanical elements.

5. The apparatus, as claimed in claim 1, wherein each locking element has an electromechanically driven, moveable locking slide, which locking slide engages behind a corresponding immovable locking abutment on at least one of the leaf and the blind frame.

6. The apparatus, as claimed in claim 5, wherein the locking slide is configured with respect to the immovable locking abutment such that a time period for locking upon closing the leaf is longer than a time period for unlocking prior to opening the leaf.

7. The apparatus, as claimed in claim 5, wherein when the locking slide is extended out at least one of the locking slide or the locking abutment has a control curve configured for moving the stationary locking abutment and, thus the leaf in the direction of the blind frame, and for locking said locking abutment into the blind frame with the predetermined contact force.

8. The apparatus, as claimed in claim 1, wherein the electromechanical drive mechanism includes an unlocking spring.

9. The apparatus, as claimed in claim 8, wherein the electromechanical drive mechanism is designed for moving a locking slide for locking and, in so doing, for placing the unlocking spring under tension.

10. The apparatus, as claimed in claim 1, wherein at least one of the locking elements is provided on a grip-sided vertical frame strut of the leaf.

11. The apparatus, as claimed in claim 10, wherein one or more of the other frame struts of the leaf has additional locking elements, which lock the leaf point-by-point.

12. An apparatus, comprising:

a blind frame and a leaf, the leaf having a surface element and being pivotable about one or more axis in relation to the blind frame, fittings operatively arranged between the leaf and the blind frame for moving the leaf in relation to the blind frame;

electromechanically actuated locking elements for locking the leaf into the frame after a closing of the leaf, each of said locking elements having a separate electromechanical drive; and wherein said locking elements are operatively configured such that, when the leaf is closed, the locking elements are displaced in relation to one another in order to press the leaf perpendicularly with respect to a plane of the surface element against the blind frame with a predetermined contact force, wherein electromagnetic or electromechanical functional elements are provided for at least one or more of the fittings, for moving the leaf in relation to the blind frame, wherein the electromechanical drive mechanism includes an unlocking spring, wherein the electromechanical drive mechanism is designed for moving a locking slide for locking and, in so doing, for placing the unlocking spring under tension, wherein the locking slide and the tensioning of the unlocking spring are carried out by an eccentric arrangement.

13. The apparatus, as claimed in claim 12, wherein the eccentric arrangement includes an eccentric pin, which moves on a circular path.

14. The apparatus, as claimed in claim 13, further comprising a drive housing, which accommodates an electric motor and a gear, and wherein the unlocking spring is a helical spring.

15. The apparatus, as claimed in claim 14, wherein the unlocking spring envelops the locking slide and is braced against two stops, which are moveable in relation to each other and of which one is fixed in position at the locking slide.

16. The apparatus, as claimed in claim 13, wherein the eccentric pin acts on a radial stop on the locking slide, so that, when said eccentric pin moves initially on its circular path for locking, it advances the locking slide outwards out of a drive housing until a position is reached, in which the tension on the unlocking spring may be relaxed for unlocking.

17. An apparatus, comprising:

a blind frame and a leaf, the leaf having a surface element and being pivotable about one or more axis in relation to the blind frame, fittings operatively arranged between the leaf and the blind frame for moving the leaf in relation to the blind frame;

electromechanically actuated locking elements for locking the leaf into the frame after a closing of the leaf, each of said locking elements having a separate electromechanical drive; and wherein said locking elements are operatively configured such that, when the leaf is closed, the locking elements are displaced in relation to one another in order to press the leaf perpendicularly with respect to a plane of the surface element against the blind frame with a predetermined contact force, wherein the electromechanical drive mechanism includes an unlocking spring, wherein the electromechanical drive mechanism is designed for moving a locking slide for locking and, in so doing, for placing the unlocking spring under tension, wherein the locking slide and the tensioning of the unlocking spring are carried out by an eccentric arrangement, wherein the eccentric arrangement includes an eccentric pin, which moves on a circular path, wherein the eccentric pin acts on a radial stop on the locking slide, so that, when said eccentric pin moves initially on its circular path for locking, it advances the locking slide outwards out of a drive housing until a position is reached, in which the tension on the unlocking spring may be relaxed for unlocking, wherein after traversing less than half the circular path of the eccentric pin, the locking position is reached and as the eccentric pin continues to traverse the circular path, the moveable locking slide extends further, until it reaches a position, in which it slides past a head piece at the locking slide with the control curve, so that the leaf may disengage from the blind frame.

* * * * *